United States Patent [19]

Kuhnke

[11] 4,023,460

[45] May 17, 1977

[54] INTONATION AID FOR THE VIOLIN, VIOLA AND CELLO AND OTHER INSTRUMENTS OF THE VIOLIN FAMILY

[76] Inventor: Horst F. Kuhnke, 9 Echo Court, Hawthorn Woods, Ill. 60047

[22] Filed: Apr. 21, 1976

[21] Appl. No.: 679,008

[52] U.S. Cl. ..... 84/314; 84/315; 84/485 SR

[51] Int. Cl.[2] ..... G10D 3/06

[58] Field of Search ..... 84/314, 315, 274, 312, 84/485

[56] References Cited

UNITED STATES PATENTS

| | | | |
|---|---|---|---|
| 652,353 | 6/1900 | Edgren | 84/314 |
| 1,795,825 | 3/1931 | Bonner | 84/314 |
| 3,103,846 | 9/1963 | Webster | 84/314 |
| 3,688,632 | 9/1972 | Perez | 84/314 |

FOREIGN PATENTS OR APPLICATIONS

| | | | |
|---|---|---|---|
| 523,049 | 4/1921 | France | 84/314 |

*Primary Examiner*—Stephen J. Tomsky
*Attorney, Agent, or Firm*—Allegretti, Newitt, Witcoff & McAndrews

[57] ABSTRACT

An intonation aid for instruments of the violin family is molded from a plastic material as a thin, curved member which fits over the fingerboard. The aid includes a plurality of spaced stops arranged at different acute angles transverse to the strings thereby defining finger positions for the distinct half notes in the scale up to the second octave.

4 Claims, 6 Drawing Figures

SCALE LAYOUT FOR ESTABLISHING PLANAR PROJECTION OF INTONATION A/D - $\frac{5}{48}$ SIZE

INTONATION AID FOR THE VIOLIN, VIOLA AND CELLO AND OTHER INSTRUMENTS OF THE VIOLIN FAMILY

BACKGROUND OF THE INVENTION

This invention relates to an intonation aid for instruments of the violin family and, more particularly, to an aid which may be easily attached to and detached from the fingerboard of an instrument, such as a violin.

When playing an instrument of the violin family of the type played with a bow such as a violin, viola, cello or the like, different notes result from engaging the strings against different parts of the fingerboard. Proper placement of the strings against the fingerboard is necessary to achieve correct string or chord length and thus produce notes of proper pitch. Finger placement particularly by unskilled musicians may be improper. An aid for placement of fingers is thus desirable.

Bonner, in U.S. Pat. No. 1,795,825, discloses an aid identified as a fretting attachment for stringed instruments. The device of Bonner comprises a foundation strip which fits over the fingerboard. Spaced fretting strips on the foundation strip are transverse or perpendicular to the strings. This arrangement provides a guide for placement of the fingers on the strings against the fingerboard.

A device of the type disclosed by Bonner has not been commercially practiced to the knowledge of applicant, possibly because of the complex construction of the frets or perhaps because the geometry and construction of the fretting strips was not satisfactory. Moreover, it is likely that the Bonner device did not provide notes of proper pitch for all strings because the scale positions for each string are shown by Bonner to be on the same line transverse to the strings. Applicant made the development of the present invention as a device which overcomes such disadvantages.

SUMMARY OF THE INVENTION

The present invention comprises an improved intonation aid which includes a unitary, molded member that may be attached to the fingerboard of a stringed instrument. The molded member includes integral ridges forming an angle with the strings. Importantly, the ridges form an acute angle with the longitudinal axis of the fingerboard and thereby account for the difference in thickness, tension and elasticity of the lower strings relative to the higher strings. A specific table of dimensions for placement of the ridges is disclosed as well as a novel construction of the integrally molded intonation aid.

It is thus an object of the invention to provide an improved intonation aid for stringed instruments.

Another object is to provide an intonation aid fabricated from a plastic material which includes an adhesive backing for easy attachment to the fingerboard.

A further object of the present invention is to provide an intonation aid which compensates for the variation in string elasticity and tension of the lower strings of an instrument relative to higher strings.

Still a further object of the present invention is to provide an intonation aid which may be used with existing instruments of the violin family without altering the quality of sound of the instrument and further without altering the structure of the stringed instrument.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
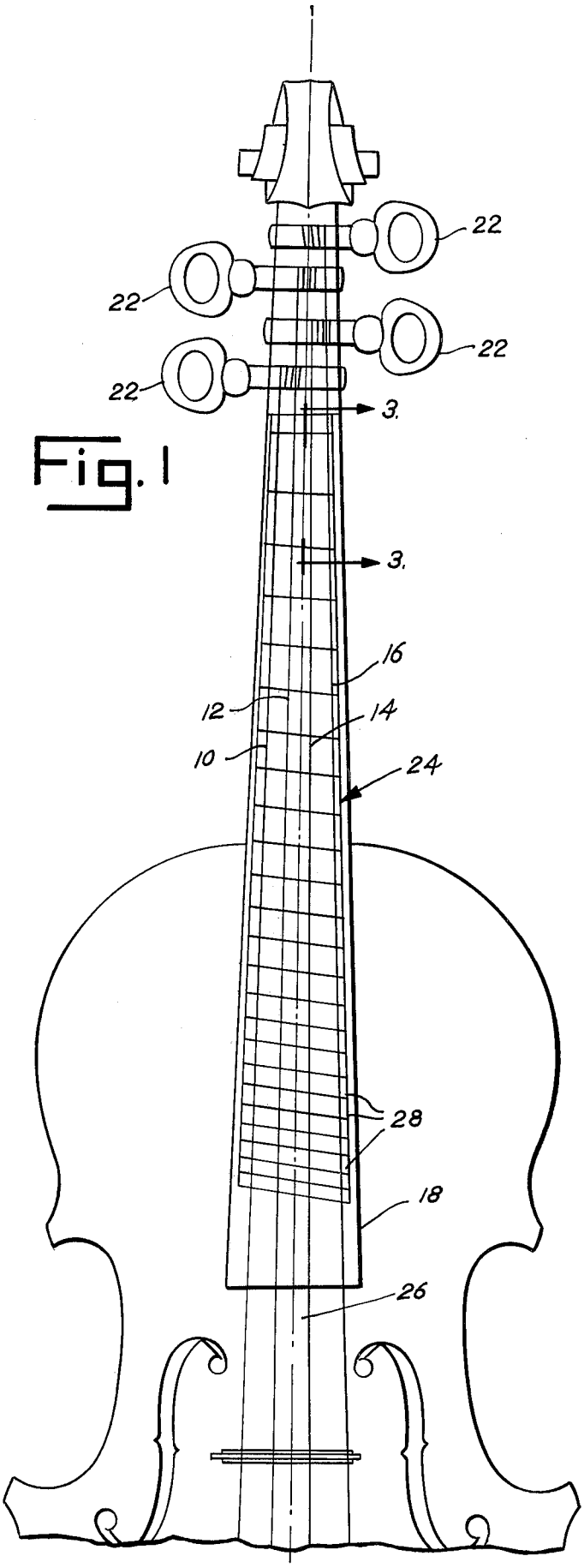
FIG. 1 is a partial plan view of a violin incorporating the intonation aid of the present invention.
Figure 2:
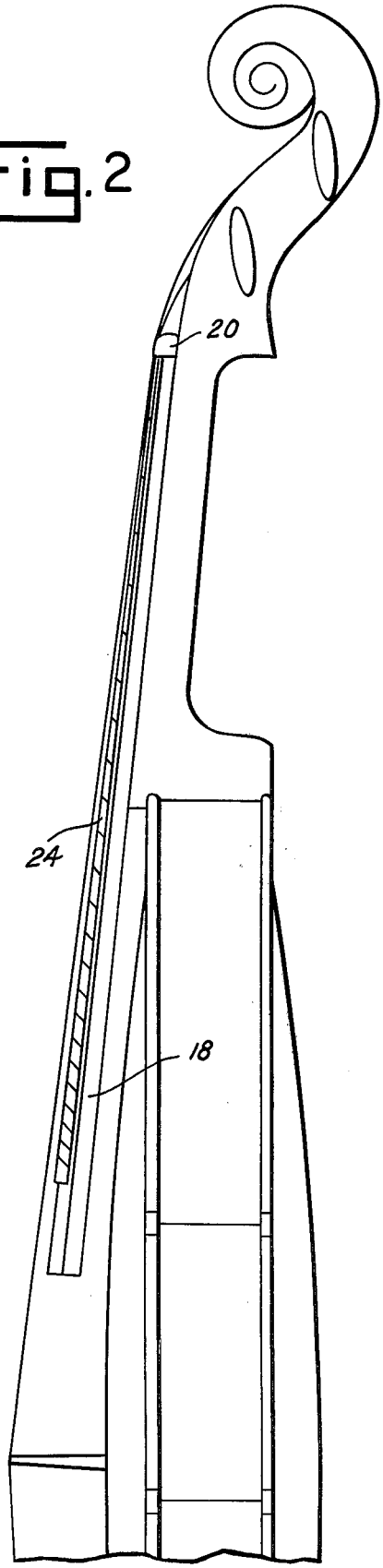
FIG. 2 is a side view of the violin shown in FIG. 1.
Figure 3:
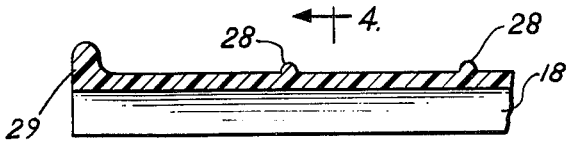
FIG. 3 is a cross-sectional view of the aid taken along the line 3—3 in FIG. 1.
Figure 4:
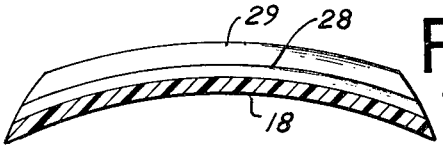
FIG. 4 is a cross-sectional view of the aid taken along the line 4—4 in FIG. 3.

FIGS. 1 and 2 illustrate a typical instrument of the violin family utilizing the intonation aid of the present invention. The instrument illustrated is a violin of the Stradivarius type. Strings 10, 12, 14, and 16 are attached over a fingerboard 18. The strings 10, 12, 14, and 16 fit over a notched nut 20. Each string may be maintained at proper tension by an associated key 22. String 10 is a lower or G string. String 12 is a D string. String 14 is an A string, and string 16 is the E string. String 10 is the lower string and is thicker and less elastic than the succeeding strings.

Intonation aid 24 is positioned on the fingerboard 18. Aid 24 is substantially the same curvature as fingerboard 18 so that it may be attached by adhesive to the fingerboard 18. The aid 24 is preferably molded from a plastic or elastomeric material. The thickness of the aid 24 is minimal to preserve spacing between the strings 10, 12, 14, 16 and the aid 24.

The aid 24 and board 18 have a coincident longitudinal axis 26. Strings 10, 12, 14, and 16 are not parallel to the axis 26. Rather, strings 10, 12, 14 and 16 form small acute angles with the axis 26.

Figure 5:
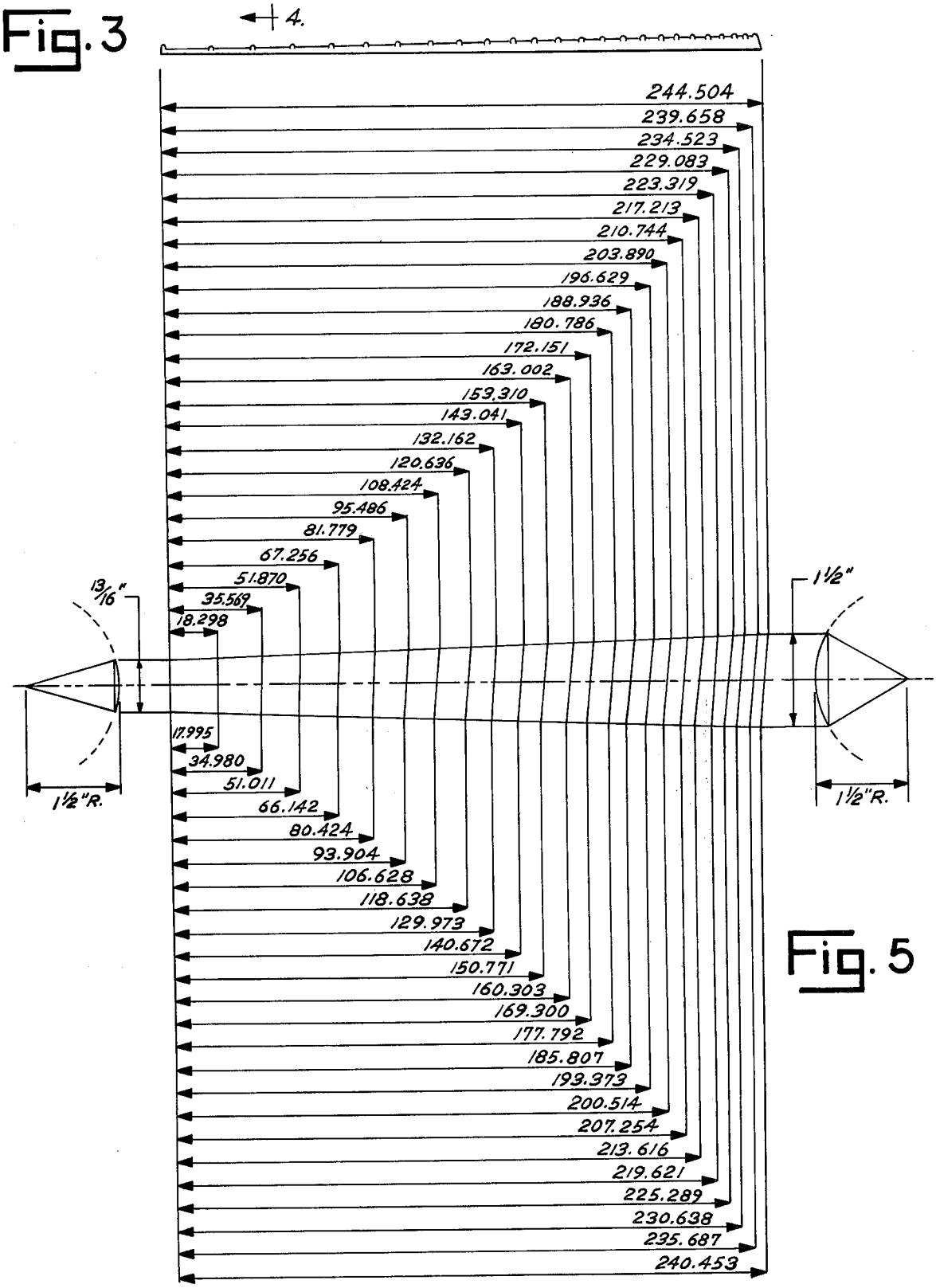
FIG. 5 is a top, plan view of the aid wherein the ridges are dimensionally set forth for a Stradivarius violin.

The aid 24 includes a plurality of separate ridges 28 obliquely transverse to the axis 26. The projection of each ridge forms a distinct acute angle with the axis 26 as shown in FIG. 5. Thus, each ridge 28 defines an arc on the surface of the aid 24. The arc, in turn, defines a planar projection which forms a distinct acute angle with the axis 26, as illustrated in FIG. 5. An end ridge 29 of aid 24 fits against nut 20.

The particular placement of ridges 28 and the angular relation of the ridge 28 and axis 26 is determined by identifying the proper finger position of each string 10, 12, 14, 16 for each half note in the scale. Note the correct finger position for each scale position of the four strings 10, 12, 14, 16 does not lie precisely on a line transverse to the axis 26. In other words, the scale positions are not on a transverse or perpendicular line to the axis 26. Rather, the line is angled, as illustrated, to accommodate for the thickness, elasticity and other characteristics of each string 10, 12, 14, 16 and the placement of the string relative to the fingerboard.

Applicant has discovered this relationship for the various stringed instruments and the relationship between each instrument. For a full size Stradivarius violin the following table has been determined. This is illustrated in FIG. 5.

TABLE I

| Stop or Ridge No. | Distance from nut to G string edge of aid (mm.) | Distance from nut to E string edge of aid (mm.) |
|---|---|---|
| 1 | 17.995 | 18.298 |
| 2 | 34.980 | 35.569 |
| 3 | 51.011 | 51.870 |
| 4 | 66.142 | 67.256 |
| 5 | 80.424 | 81.779 |
| 6 | 93.904 | 95.486 |
| 7 | 106.628 | 108.424 |
| 8 | 118.638 | 120.636 |
| 9 | 129.973 | 132.162 |
| 10 | 140.672 | 143.041 |
| 11 | 150.771 | 153.310 |
| 12 | 160.303 | 163.002 |
| 13 | 169.300 | 172.151 |
| 14 | 177.792 | 180.786 |
| 15 | 185.807 | 188.936 |
| 16 | 193.373 | 196.629 |
| 17 | 200.514 | 203.890 |
| 18 | 207.254 | 210.744 |
| 19 | 213.616 | 217.213 |
| 20 | 219.621 | 223.319 |
| 21 | 225.289 | 229.083 |
| 22 | 230.638 | 234.523 |
| 23 | 235.687 | 239.658 |
| 24 | 240.453 | 244.504 |

It is noted that the projection of the ridges of the scale for the aid 24 forms an acute angle with the axis 26 which is distinct for each scale position.

Every type of stringed instrument has a spacing and angular position for ridges 28 which is distinct depending upon instrument size. The shape of aid 24 and ridges 28 may be calculated in the following manner for the three types of stringed instruments and fourteen different sizes.

Figure 6:
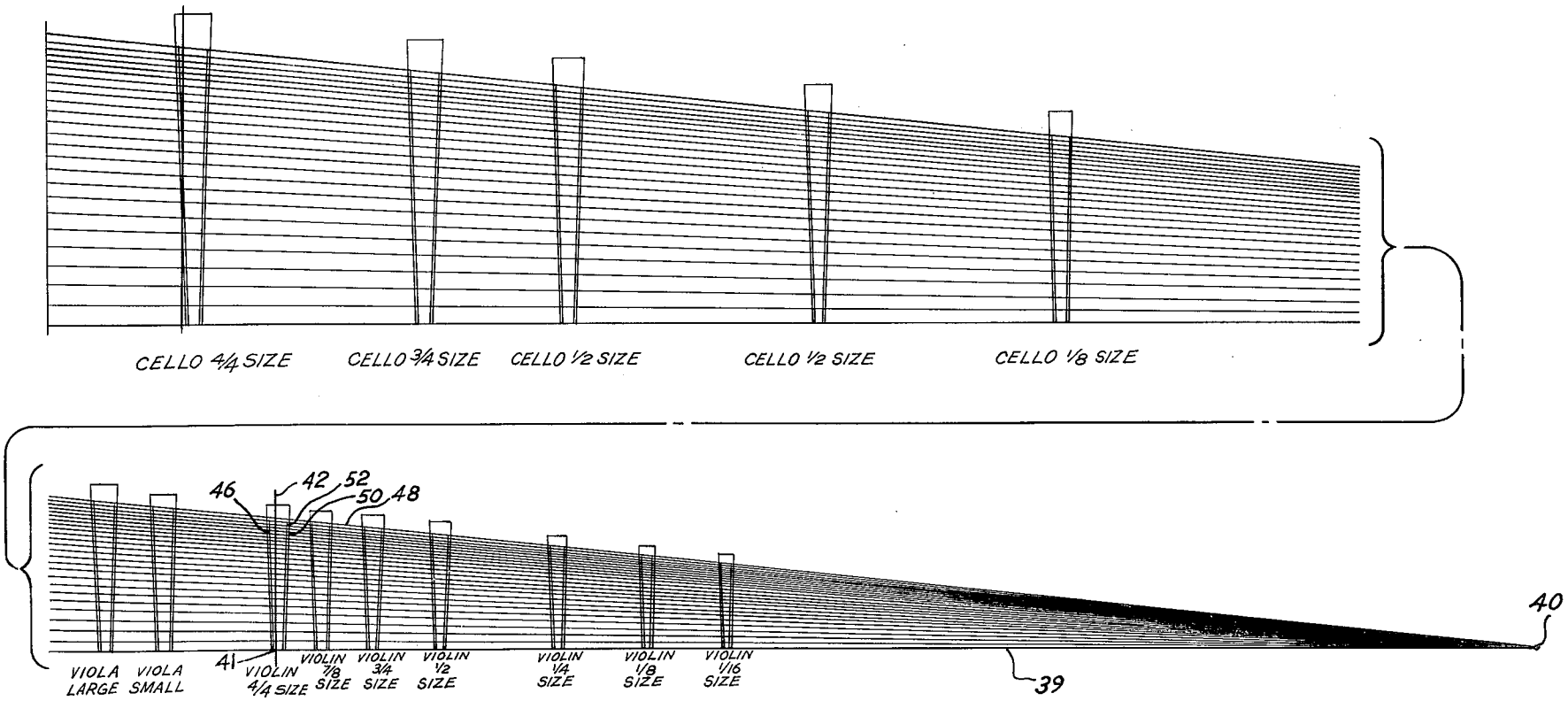
FIG. 6 is a general layout of the geometrical array for designing aids for various stringed instruments.

First, as shown in FIG. 6, a base line 39 is established. An apex or base point 40 is then established arbitrarily on line 39. Next, a fixed multiple of the scale distance for any one of the stringed instruments is measured from point 40. For example, the scale distance (distance from nut to bridge) for a full size violin is 325 mm. Seven times the scale distance is a point 41.

At point 41, a perpendicular line 42 to base line 39 is provided. The line 42 is generally associated with the higher string for the violin.

Half notes through the second octave are then established on the perpendicular 42. Thus, the second octave distance for the full size violin is calculated to be 325 mm × ¾ = 243.75 mm. The second octave point 44 is then marked on line 42. The succeeding half notes are then calculated in the manner known to those skilled in the art and they are inserted on the layout FIG. 6. Following is a table of the calculated half note positions for the full size violin:

Distance from Nut (Point 41) to Scale Position (mm) on Line 42 For Full size (4/4) Violin 243.750 . . . Second Octave Position
238.920 . . .
233.801 . . .
228.378 . . .
222.633 . . .
216.456 . . .
210.097 . . .
203.264 . . . First Octave Position
196.025 . . .
188.355 . . .
180.229 . . .
171.620 . . .
162.500 . . .
152.839 . . .
142.602 . . .
131.756 . . .
120.265 . . .
108.091 . . .
95.193 . . .
81.528 . . .
67.050 . . .
51.711 . . .
35.460 . . .
18.242 . . .
.000 . . . Fingerboard Nut Position Point 46 is one of the many typical calculated half note points. Rays or lines 48 are then drawn from each half note point on line 42 through apex 40.

The other strings of the violin are then projected relative to line 42 by use of a full scale overlay of the fingerboard of the violin. A projection 50 of the fingerboard and a projection 52 of the intonation aid are thus provided for the violin as shown in FIG. 6. These projections will be full size, though FIG. 6 is not a full scale projection. The projection 52 is also a planar projection of the final curved aid.

Aids for other instruments are easily provided by reference to the drawing, FIG. 6. For example, a full size cello (4/4 size) has a scale point of 685.00 mm and a second octave point of 513.75 mm. To locate the size and shape of a ridged aid for such a cello, a perpendicular to base line 40 is positioned at that point on a full size diagram of the type in FIG. 6 to define a second octave distance from line 40 to line 48 of 513.75 mm. The strings or fingerboard of the cello may then be projected onto FIG. 6 and the shape of the required aid as well as the number and angle of ridges becomes evident. The system works for all instruments of the violin family as illustrated in part in FIG. 6.

What is claimed is:

1. An improved intonation aid for attachment to stringed musical instruments of the type including a fingerboard with a nut at one end thereof, said fingerboard having a convex surface opposed to the strings with a longitudinal axis perpendicular to the plane of the arc defining the convex surface, the strings of said instrument being suspended over the fingerboard, said aid comprising in combination:

a series of spaced stops positioned on the fingerboard beneath the strings, said stops comprising spaced ridges forming an acute angle with the longitudinal axis, the angle being distinct for each stop and progressively increasing with the distance of the stop from the nut, said stops being positioned beneath said strings at scale positions, the position of intersection for each single stop being closer to the nut for lower strings than for the succeeding higher string so as to accommodate for distinct string tension, thickness, and elasticity for each string and for each separate instrument.

2. The improved aid of claim 1 wherein said instrument comprises a full size violin with a fingerboard having a radius of curvature 1½ inch and said stops are projected in a plane according to the following:

width at nut: 13/16 inch
width at 9.632 inch from nut: 1½ inch

TABLE I

| Stop or Ridge No. | Distance from nut to G string edge of aid (mm.) | Distance from nut to E string edge of aid (mm.) |
|---|---|---|
| 1 | 17.995 | 18.298 |
| 2 | 34.980 | 35.569 |
| 3 | 51.011 | 51.870 |
| 4 | 66.142 | 67.256 |
| 5 | 80.424 | 81.779 |
| 6 | 93.904 | 95.486 |
| 7 | 106.628 | 108.424 |
| 8 | 118.638 | 120.636 |
| 9 | 129.973 | 132.162 |
| 10 | 140.672 | 143.041 |
| 11 | 150.771 | 153.310 |
| 12 | 160.303 | 163.002 |
| 13 | 169.300 | 172.151 |
| 14 | 177.792 | 180.786 |
| 15 | 185.807 | 188.936 |
| 16 | 193.373 | 196.629 |
| 17 | 200.514 | 203.890 |
| 18 | 207.254 | 210.744 |
| 19 | 213.616 | 217.213 |
| 20 | 219.621 | 223.319 |
| 21 | 225.289 | 229.083 |
| 22 | 230.638 | 234.523 |
| 23 | 235.687 | 239.658 |
| 24 | 240.453 | 244.504 |

3. The improved aid of claim 1 wherein said aid comprises a molded sheet of plastic material including integrally molded stops, and adhesive means on the underside of said aid for attachment thereof to the fingerboard.

4. A method for manufacture of an intonation aid for instruments of the violin family of the type having a nut, a bridge, strings suspended between the nut and bridge, and a fingerboard beneath the strings, comprising the steps of:

a. establishing a base line with an apex at one end;

b. forming a perpendicular to the base line at a distance of seven times the scale;

c. spotting the second octave point and all half scale points on the perpendicular and drawing rays from the points through the apex;

d. overlaying the fingerboard on the lined figure with the perpendicular coinciding with the higher string of the instrument;

e. forming an aid having a plurality of ridges coincident with the projection of rays on the fingerboard; and f. affixing the aid to the fingerboard.

* * * * *